US006843860B2

(12) United States Patent
Haentjes

(10) Patent No.: US 6,843,860 B2
(45) Date of Patent: Jan. 18, 2005

(54) METHOD AND DEVICE FOR PICKLING HOT-ROLLED SPECIAL STEEL STRIPS

(75) Inventor: Michael Haentjes, Essen (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/258,909

(22) PCT Filed: May 5, 2001

(86) PCT No.: PCT/EP01/05118

§ 371 (c)(1),
(2), (4) Date: Oct. 30, 2002

(87) PCT Pub. No.: WO01/86024

PCT Pub. Date: Nov. 15, 2001

(65) Prior Publication Data

US 2003/0178045 A1 Sep. 25, 2003

(30) Foreign Application Priority Data

May 8, 2000 (DE) ..... 100 22 083

(51) Int. Cl.[7] ..... C23G 1/02

(52) U.S. Cl. ..... 134/41; 134/2; 134/3; 134/15; 134/26; 134/28

(58) Field of Search ..... 134/2, 3, 15, 26, 134/28, 41; 29/81.01, 81.06

(56) References Cited

U.S. PATENT DOCUMENTS 2,987,425 A * 6/1961 Elliott ..... 134/28
5,131,126 A * 7/1992 Katsuki et al. ..... 29/81.06
5,821,212 A 10/1998 Peterson

FOREIGN PATENT DOCUMENTS

JP 60-63390 * 4/1985

* cited by examiner

*Primary Examiner*—M. Kornakov
(74) *Attorney, Agent, or Firm*—Herbert Dubno

(57) ABSTRACT

The invention relates to a method for pickling hot-rolled special steel strips (1) having an austenite, ferrite and/or martensite structure. The inventive method is carried out in a pickling line (7) with pickling sections (8) containing acids and rinsing sections (9) containing rinsing water (15). The aim of the invention is to provide a method that does not require an additional stretch-leveling step for descaling. The costs for pickling are reduced by pickling the hot-rolled special steel strip (1) in the pickling sections (8) with hydrochloric acid (13) and rinsing it in the first rinsing sections (9) with azotic acid (14) or an equivalent substitute pickling medium (14*b*) and treating it in further rinsing sections (9) with rinsing water (15).

10 Claims, 2 Drawing Sheets

Normal Steel Production: The pickling tanks were operated with hydrochloric acid
The rinsing tanks were operated with rinse water High Quality Steel Production: The pickling tanks 1-3 were operated with hydrochloric acid
The rinse stages 1 and 2 were operated with nitric acid
The rinse stages 3-6 were operated with rinse water

METHOD AND DEVICE FOR PICKLING HOT-ROLLED SPECIAL STEEL STRIPS

CROSS REFERENCE TO RELATED APPLICATION

This application is a national stage of PCT/EP 01/105118 filed 5 May 2001 and based upon German national application 100 22 083.5 of 8 May 2000 under the International Convention.

FIELD OF THE INVENTION

The invention relates to a method and an apparatus for pickling high-grade-steel hot-rolled strip with an austenitic, ferritic and/or martensitic structure and which is carried out in a pickling line with pickling stages with acid and rinsing stages with rinse water.

BACKGROUND OF THE INVENTION

In the pickling of high-grade-steel hot-rolled strip (DE 195 05 324 C2), the high grade steel strip is passed through an annealing and pickling line. Prior to the pickling a descaling is effected which involves two processing segments: blasting and pickling. In the blasting, the strip surface is mechanically descaled in that particles impinge upon the strip surface which remove the scale because of their kinetic energy. It is known to include in some annealing and pickling lines an additional stretch leveller so as to improve strip quality with respect to the planarity of the strip on the one hand and on the other hand to produce cracks in the scaling layer which facilitates the later chemical pickling process. Following the mechanical preliminary descaling steps, a wet chemical pickling is carried out. This pickling process can, depending upon the apparatus configuration, comprise a plurality of steps. For purely hot-rolled strip as a rule the pickling involves a sulfuric acid prepickling with residual descaling being effected in an acid mixture of nitric acid and hydrofluoric acid.

This known process is disadvantageous because of the use of the blast method which increases the roughness of the strip surface and thus reduces strip quality. In addition, the operating cost because of the use of the acid mixture and especially the hydrofluoric acid is very high.

The method described at the outset is known (EP 0 706 840 A2) for the production of high-quality cold-rolled steel strip carried out inline with the working steps directly following one another of descaling the roughed out strip, reducing the roughed out strip to final thickness, annealing and pickling.

OBJECT OF THE INVENTION

It is the object of the invention to carry out the pickling without an additional blast process for descaling and above all to lower the cost for the pickling.

SUMMARY OF THE INVENTION

The object set forth is achieved according to the invention in that the high-quality-steel hot-rolled strip is pickled in the pickling stage with hydrochloric acid and in a first rinsing stage is washed with nitric acid or an equivalent replacement pickling medium and in further rinsing stages is treated with rinse water. The method thus is carried out without an additional blast operation and the costs for the acids are reduced. In pickling with nitric acid or an equivalent replacement pickling medium, still remaining scaling residues on the strip are removed. The use of a blast chamber is not required. Since the annealing of the high-grade-steel hot-rolled strip, depending upon the further processing is not mandatory, the costly production with an annealing and pickling line under earlier circumstances can be bypassed. The prepickling in hydrochloric acid reduces the amount of metal dissolved in the nitric acid drastically. Thus there is a reduction of known problematical reaction products ($No_x$-gas in the effluent air and nitrate in the effluent water associated with the method). The known drawbacks also can be eliminated by the use of a corresponding replacement medium for the nitric acid. According to the teachings of the invention, in addition, pickled high-quality-steel hot-rolled strip is produced with an improved surface quality. In addition the operating costs are substantially lower by comparison to the known method.

In the development of the invention the high quality steel hot rolled strip is pickled in at least one pickling stage with hydrochloric acid, the advantage is the drastic reduction in the dissolved metal quantity by prepickling.

A further improvement resides in that the high quality steel hot rolled strip is treated in at least one or in a number of rinsing stages with the nitric acid or an equivalent replacement medium. Advantageously a complete descaling is achieved.

According to a further feature it is provided that the high-quality hot-rolled steel strip is then treated in two or more heating stages with rinse water. That eliminates completely the acids used.

The improvement of the invention resides further in that as the equivalent replacement pickling medium a pickling medium containing hydrogen peroxide is provided. This pickling medium operates in the same manner and way as the nitric acid.

The equivalent replacement pickling medium can be formed by a mixture of sulfuric or hydrochloric acid with hydrogen peroxide and other additives.

The apparatus for pickling high-quality-steel hot-rolled strip with an austenitic, ferritic and/or martensitic structure which can be fed through a pickling line optionally downstream of a soft annealing furnace achieves the objects set forth according to the invention in that the high-quality hot-rolled strip is treatable in a pickling line which is comprised of a plurality of pickling tanks with hydrochloric acid and a plurality of rinsing tanks with nitric acid or a replaced pickling medium and further rinsing tanks with rinse water. The advantages are those already given for the improvements of the method steps over the state of the art.

The number of pickling stages can be varied. A preferred arrangement is to provide in the pickling line that the first three pickling tanks are to be filled with hydrochloric acid.

The prepickling can also be extended or shortened by varying the number of pickling stages in that the pickling line the rinsing stages have rinsing tanks with nitric acid or a replacement pickling medium and then rinsing tanks with rinse water.

An advantageous development is thereby proposed in which the rinsing stages are formed by at least one rinsing tank with nitric acid or with a replacement pickling medium and from at least two rinsing tanks with rinse water.

BRIEF DESCRIPTION OF THE DRAWING

An embodiment of the pickling line is shown in the drawing and the method is described below in connection therewith. In the drawing.

SPECIFIC DESCRIPTION

Figure 1:
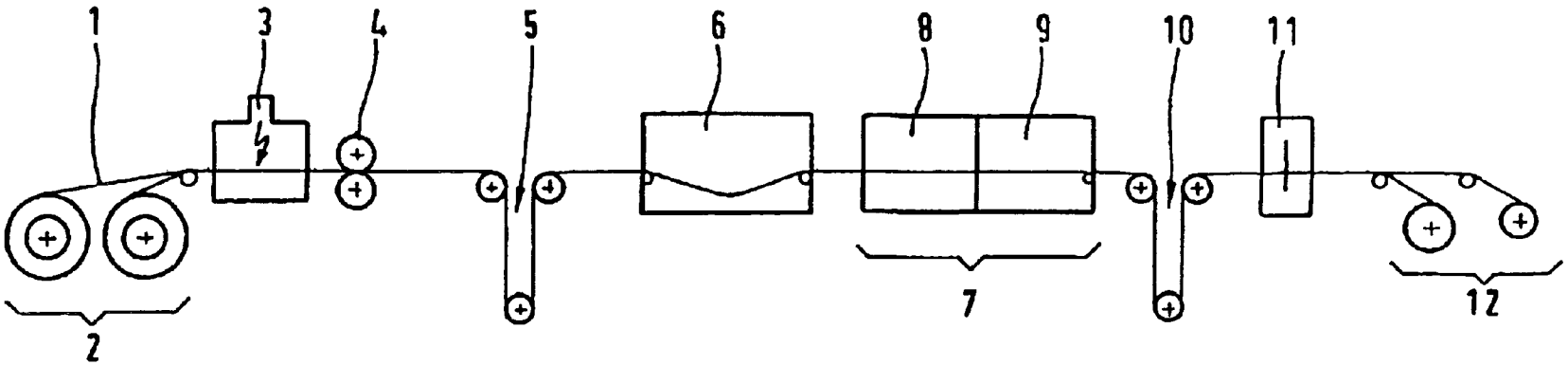
FIG. 1 (PRIOR ART)
FIG. 1 is a diagram of a complete strip pickling apparatus.

According to FIG. 1, the high-quality steel e.g. stainless steel hot-rolled strip 1 from strip coils of an inlet section 2 is passed through a welding device 3 (for a coil replacement) and through a trimming machine 4 into an inlet loop former 5, and if required through a soft annealing furnace 6 into the pickling line 7. The pickling line 7 comprises pickling stages 8 and rinsing stages 9, which will be described in greater detail hereinafter. From the last rinsing stage 9, the high quality hot strip 1 passes through an outlet loop former 10 and an outlet shear 11. During a continuous operation the high quality steel hot strip 1 is wound up again in coils in the outlet section 12.

Figure 2:
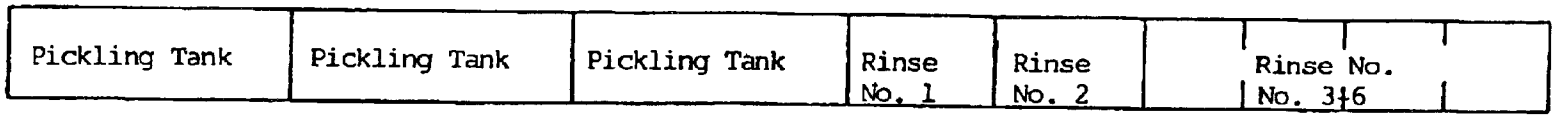
FIG.2 (PRIOR ART)
FIG. 2 is a block diagram for comparison of the pickling stage of a standard steel production.

According to FIG. 2 during normal steel production the pickling line 7 in the pickling stage 8 is operated with three pickling tanks and hydrochloric acid while the rinsing stage operates totally with rinse water (rinses 1 and 2, rinses 3–6).

Figure 3:
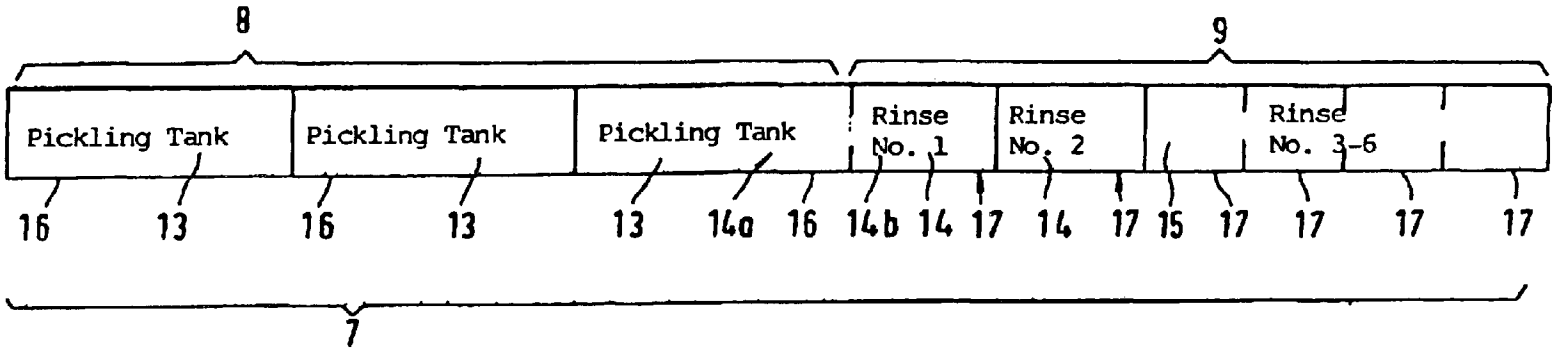
FIG. 3 is a block diagram of the pickling stages of the pickling and rinse tanks in high quality steel production.

According to FIG. 3, the pickling line 7 is constructed as follows. In pickling tanks 16, the pickling line 7 has in the pickling stages 8 as the pickling medium 14*a*, hydrochloric acid 13. The rinsing stages 9 are formed by rinsing tanks 17 in which rinse Nr. 1 and rinse Nr. 2 contain nitric acid 14 or a replacement pickling medium 14*b*. In the following rinsing stages 9, rinse water 15 is used.

The method is carried out so that the high quality steel hot strip is pickled in the pickling stages 8 with hydrochloric acid 13 and in the first rinsing stage 9 with nitric acid 14 or a equivalent replacement pickling medium and in the further rinsing stage with rinse water 15. Two or more pickling stages 8 with hydrochloric acid can be used. Also the high quality steel hot strip 1 can be treated in two or more of the rinsing stages 9 with the nitric acid 14 or an equivalent replacement pickling medium 14*b*. Then the high quality hot steel strip 1 can be rinsed in two or more rinsing stages.

What is claimed is:

1. A method of pickling high-quality steel strip consisting essentially the steps of:

(a) passing high-quality hot-rolled steel strip with an austenitic, ferritic or martensitic structure through a soft annealing furnace immediately followed by a pickling line consisting essentially only of pickling and rinsing stages;

(b) in at least one pickling stage of said pickling stages, initially pickling said high-quality hot-rolled steel strip with hydrochloric acid;

(c) in at least one rinsing stage of said rinsing stages following step (b), rinsing said high-quality hot-rolled steel strip with nitric acid or a mixture of sulfuric acid with hydrogen peroxide or a mixture of hydrochloric acid with hydrogen peroxide; and (d) thereafter rinsing said high-quality hot-rolled steel strip with water in at least one further one of said rinsing stages.

2. The method defined in claim 1 wherein said high-quality hot-rolled steel strip is pickled in step (b) in at least two of said pickling stages with hydrochloric acid.

3. The method defined in claim 2 wherein said high-quality hot-rolled steel strip is rinsed in step (c) in at least two of said rinsing stages with nitric acid or a mixture of sulfuric acid with hydrogen peroxide or a mixture of hydrochloric acid with hydrogen peroxide.

4. The method defined in claim 3 wherein said high-quality hot-rolled steel strip is rinsed in step (d) with water in at least two of said rinsing stages.

5. The method defined in claim 1, wherein said high-quality hot-rolled steel strip is rinsed in step (c) in at least two of said rinsing stages with nitric acid or a mixture of sulfuric acid with hydrogen peroxide or a mixture of hydrochloric acid with hydrogen peroxide.

6. The method defined in claim 1 wherein said high-quality hot-rolled steel strip is rinsed in step (d) with water in at least two of said rinsing stages.

7. An apparatus for pickling high-quality steel strip comprising:

a soft annealing furnace; and a pickling line positioned immediately downstream of said furnace and traversed by high-quality hot-rolled steel strip with an austenitic, ferritic or martensitic structure, said pickling line consisting essentially only of pickling and rinsing stages and including:

at least one pickling tank of said pickling stages for initially pickling said high-quality hot-rolled steel strip with hydrochloric acid, at least one rinsing tank of said rinsing stages following pickling with hydrochloric acid for rinsing said high-quality hot-rolled steel strip with nitric acid or a mixture of sulfuric acid with hydrogen peroxide or a mixture of hydrochloric acid with hydrogen peroxide, and at least one further rinsing tank of said rinsing stages for thereafter rinsing said high-quality hot-rolled steel strip with water.

8. The apparatus defined in claim 7 wherein said pickling stages have three pickling tanks with hydrochloric acid traversed in succession by said high-quality hot-rolled steel strip.

9. The apparatus defined in claim 8 wherein said rinsing stages have two rinsing tanks with nitric acid or a mixture of sulfuric acid with hydrogen peroxide or a mixture of hydrochloric acid with hydrogen peroxide following the three pickling tanks with hydrochloric acid.

10. The apparatus defined in claim 9 wherein said rinsing stages have a plurality of tanks with water following the two rinsing tanks with nitric acid or a mixture of sulfuric acid with hydrogen peroxide or a mixture of hydrochloric acid with hydrogen peroxide.

* * * * *